US007383780B1

(12) United States Patent
Oxley et al.

(10) Patent No.: US 7,383,780 B1
(45) Date of Patent: Jun. 10, 2008

(54) TAPE EDGE WORK STATION

(75) Inventors: Warren G. Oxley, Auburn, GA (US); Jesse Morrison, Lawrenceville, GA (US); Elvin C. Price, Dacula, GA (US); Danny Murphy, Dacula, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 219 days.

(21) Appl. No.: 11/406,114

(22) Filed: Apr. 18, 2006

Related U.S. Application Data

(60) Provisional application No. 60/672,597, filed on Apr. 18, 2005.

(51) Int. Cl.
*D05B 11/00* (2006.01)
*D05B 27/10* (2006.01)
*D05B 35/06* (2006.01)

(52) U.S. Cl. ..... 112/475.08; 112/2.1

(58) Field of Classification Search ..... 112/2.1, 112/152, 153, 475.01, 475.08; 414/222.07, 414/222.11; 198/339.1, 402, 633, 837; 271/69
See application file for complete search history.

(56) References Cited

U.S. PATENT DOCUMENTS

| | | | | |
|---|---|---|---|---|
| 810,882 | A * | 1/1906 | Phelps | 112/2.1 |
| 1,322,842 | A * | 11/1919 | Sutton | 112/2.1 |
| 1,947,058 | A | 2/1934 | Pittoni | |
| 2,869,493 | A * | 1/1959 | Seavert | 112/2.1 |
| 3,013,513 | A | 12/1961 | Judelson | |
| 3,083,654 | A | 4/1963 | Cash, Sr. | |
| 3,490,061 | A | 1/1970 | Docker | |
| 3,641,954 | A | 2/1972 | Kalning et al. | |
| 3,673,906 | A | 7/1972 | Cash | |
| 4,013,026 | A | 3/1977 | Hall | |
| 4,019,447 | A | 4/1977 | Blessing et al. | |
| 4,043,282 | A | 8/1977 | Fanghanel | |
| 4,067,269 | A | 1/1978 | Fanghanel | |
| 4,117,790 | A | 10/1978 | Hasegawa et al. | |
| 4,141,304 | A | 2/1979 | Masuda | |
| 4,181,085 | A | 1/1980 | Conner, Jr. | |
| 4,290,376 | A | 9/1981 | Brusasca | |
| 4,462,129 | A | 7/1984 | Brannock | |
| 4,498,404 | A | 2/1985 | Sadeh | |
| 4,691,651 | A | 9/1987 | Junemann | |
| 4,703,706 | A | 11/1987 | Plante | |
| 4,742,789 | A | 5/1988 | Pestel et al. | |
| 4,776,579 | A | 10/1988 | Romand et al. | |
| 4,793,463 | A | 12/1988 | Kane | |
| 4,794,873 | A | 1/1989 | Dordi et al. | |
| 4,813,364 | A | 3/1989 | Boser | |
| 4,821,656 | A | 4/1989 | Dordi et al. | |

(Continued)

FOREIGN PATENT DOCUMENTS

| | | |
|---|---|---|
| DE | 31 39426 A1 | 4/1983 |

(Continued)

*Primary Examiner*—Ismael Izaguirre
(74) *Attorney, Agent, or Firm*—Womble Carlyle Sandridge & Rice, PLLC

(57) ABSTRACT

A tape edge applicator workstation including a conveyor for moving a mattress or foundation along a sewing path through a tape edge applicator. The tape edge applicator applies a tape edge material about the peripheral side edges of the mattress, with the mattress generally being rotated as the tape edge material is applied about the corners thereof.

14 Claims, 4 Drawing Sheets

U.S. PATENT DOCUMENTS

| | | | | | |
|---|---|---|---|---|---|
| 4,825,787 | A | | 5/1989 | Babson et al. | |
| 4,827,856 | A | | 5/1989 | Rohr | |
| 4,838,186 | A | | 6/1989 | Resta et al. | |
| 4,905,615 | A | | 3/1990 | Pofferi | |
| 4,958,579 | A | | 9/1990 | De Weers | |
| 4,998,965 | A | | 3/1991 | Easom | |
| 5,018,462 | A | | 5/1991 | Brocklehurst | |
| 5,100,127 | A | * | 3/1992 | Melnick et al. | 119/700 |
| 5,145,144 | A | | 9/1992 | Resta et al. | |
| 5,185,897 | A | | 2/1993 | Van Laanen | |
| 5,282,433 | A | | 2/1994 | Freermann et al. | |
| 5,289,788 | A | | 3/1994 | Fukumoto | |
| 5,322,411 | A | * | 6/1994 | Elkin et al. | 414/809 |
| 5,341,755 | A | | 8/1994 | Kawasaki | |
| 5,367,968 | A | | 11/1994 | Diaz | |
| 5,368,431 | A | * | 11/1994 | Willey et al. | 414/412 |
| 5,483,909 | A | | 1/1996 | Nogueras | |
| 5,515,796 | A | | 5/1996 | Ogle et al. | |
| 5,529,004 | A | | 6/1996 | Porter et al. | |
| 5,537,699 | A | | 7/1996 | Bonaddio et al. | |
| 5,560,308 | A | | 10/1996 | Eto | |
| 5,586,511 | A | | 12/1996 | Porter et al. | |
| 5,617,802 | A | | 4/1997 | Cash | |
| 5,647,293 | A | | 7/1997 | Price et al. | |
| 5,697,309 | A | | 12/1997 | Ogle et al. | |
| 5,809,919 | A | | 9/1998 | Mitchell et al. | |
| 5,881,656 | A | | 3/1999 | Grant | |
| 5,915,319 | A | | 6/1999 | Price et al. | |
| 5,943,971 | A | | 8/1999 | Trickett et al. | |
| 6,000,352 | A | | 12/1999 | Porter et al. | |
| 6,202,579 | B1 | | 3/2001 | Olewicz et al. | |
| 6,209,468 | B1 | | 4/2001 | Marcangelo et al. | |
| 6,397,768 | B1 | | 6/2002 | Dasher et al. | |
| 6,648,585 | B2 | | 11/2003 | Block et al. | |
| 2002/0050117 | A1 | | 5/2002 | Dasher et al. | |

FOREIGN PATENT DOCUMENTS

| | | |
|---|---|---|
| DE | 37 12493 A1 | 5/1987 |
| EP | 0264 618 A1 | 4/1988 |
| EP | 0 330 285 B1 | 2/1989 |
| EP | 0682135 | 11/1995 |
| FR | 1567893 | 9/1967 |
| GB | 1384073 | 2/1975 |
| JP | 7308465 | 11/1995 |
| WO | WO 92/12282 | 7/1992 |
| WO | WO 95/25194 | 9/1995 |

* cited by examiner

TAPE EDGE WORK STATION

CROSS-REFERENCE TO RELATED APPLICATIONS

This application claims the benefit of U.S. Provisional Application Ser. No. 60/672,597, filed Apr. 18, 2005, entitled "Tape Edge Workstation," the entire contents of which is hereby incorporated by reference as if presented herein in its entirety.

FIELD OF THE INVENTION

The present invention generally relates to automated sewing equipment, and in particular to a tape edge workstation for sewing a tape edge material about the outer peripheral edges of a mattress, foundation, or other articles.

BACKGROUND OF THE INVENTION

Typically, in the finishing of bedding components such as mattresses, the bedding materials will be placed on a buildup table, which will support the bedding at a desired height, depending on the thickness or size of the bedding, for finishing sets, including the application of a tape edge along the borders of the upper and lower borders of the bedding. The application of the tape edge typically will be accomplished by a tape edge applicator or sewing head that generally is mounted adjacent the buildup table and is moved around the border or periphery of the bedding for applying the tape edge thereto. A problem that exists, however, is that at the corners of the bedding, especially where there is an offset, such as with pillow top mattresses, the sewing machine typically must be moved away from the bedding and turned so as to sew around each corner of the bedding. Such an operation generally requires considerable manual manipulation of the sewing head by an operator and results in a slow down in the process of applying the tape edge as the operator must slow production to move the tape edge machine and/or to move/adjust the bedding to continue to sew around the corners of the bedding.

Accordingly, it can be seen that a need exists for a system and method for applying a tape edge to bedding components such as mattresses and foundation sets, which addresses the foregoing and other related and unrelated problems in the art.

SUMMARY OF THE INVENTION

Briefly described, the present invention generally relates to a system or workstation for applying a tape edge material about the peripheral side edges of bedding components such as mattresses or foundation sets. The tape edge applicator workstation, generally includes a conveyor having a conveyor belt on which the bedding component is moved and rotated for application of the tape edge material along the matched, peripheral side edges thereof. The conveyor belt generally is an elongated belt of a size or length sufficient to provide a slack portion to the conveyor belt for enabling ease of removal and replacement of the conveyor belt on the frame of the tape edge workstation as needed. One or more take-up rolls generally are provided below the upper surface of the conveyor and are moveable into engagement with the slack portion of the conveyor belt. Actuators, such as pneumatic or hydraulic cylinders, drive motors or other type actuators, move the one or more take up rolls between raised, retracted positions out of engagement with the conveyor belt, and lowered, extended positions in engagement with the conveyor belt so as to make the conveyor belt taut to take-up and remove the slack portion therefrom.

A tape edge applicator is provided along one side edge of the conveyor in a position for engaging and applying the tape edge material to an upper side edge of the bedding component as the component passes thereby. The tape edge applicator generally includes a sewing head pivotally mounted on a carriage or support and a supply reel of a tape edge material that is fed into a position overlying the side edge of the bedding component for sewing thereabout as the bedding component passes through the tape edge applicator. The sewing head of the tape edge applicator can be tilted or pivoted with respect to the side edges of the bedding component and further can be raised or lowered to position the sewing head at a desired height and/or orientation as needed for application of the tape edge material to the side edges of the bedding component.

As the bedding component is moved through the tape edge applicator by the forward movement of the conveyor belt, a leading corner or side of the bedding component tends to engage and bear against a pivoting guide arm that is progressively longitudinally moved along a turning arm positioned adjacent the conveyor belt. As the trailing corner of the bedding component is detected approaching the sewing needle of the tape edge applicator, the system control will actuate the turning arm. As the turning arm is rotated across the conveyor belt, the bedding component is likewise caused to rotate or turn about the sewing needle of the tape edge applicator as the tape edge applicator continues to sew around the corner of the bedding component. The bedding component is rotated approximately 90° or until a next edge to be sewn of the bedding component is presented and aligned with the sewing head of the tape edge applicator.

A flipping mechanism is provided at the upstream or downstream end of the conveyor for rotating or flipping the bedding component. The flipping mechanism generally includes a flipper bar that is vertically extensible and is positioned to be engaged by the bedding component as the conveyor moves the bedding component off the worktable. As a result, the leading end of the mattress is lifted upwardly as the trailing end of the mattress is moved forwardly by the conveyor, causing the mattress to flip over onto its previously sewn side edges. Thereafter, the conveyor can be reversed to move the bedding component to an initial sewing position downstream from the tape edge applicator. In addition, an adjustment pad can be actuated to urge the bedding component toward the tape edge applicator to help reposition the bedding component.

Various objects, features and advantages of the present invention will become apparent to those skilled in the art upon review of the following detailed description when taken in conjunction with the accompanying drawings.

DETAILED DESCRIPTION OF THE INVENTION

Figure 1:
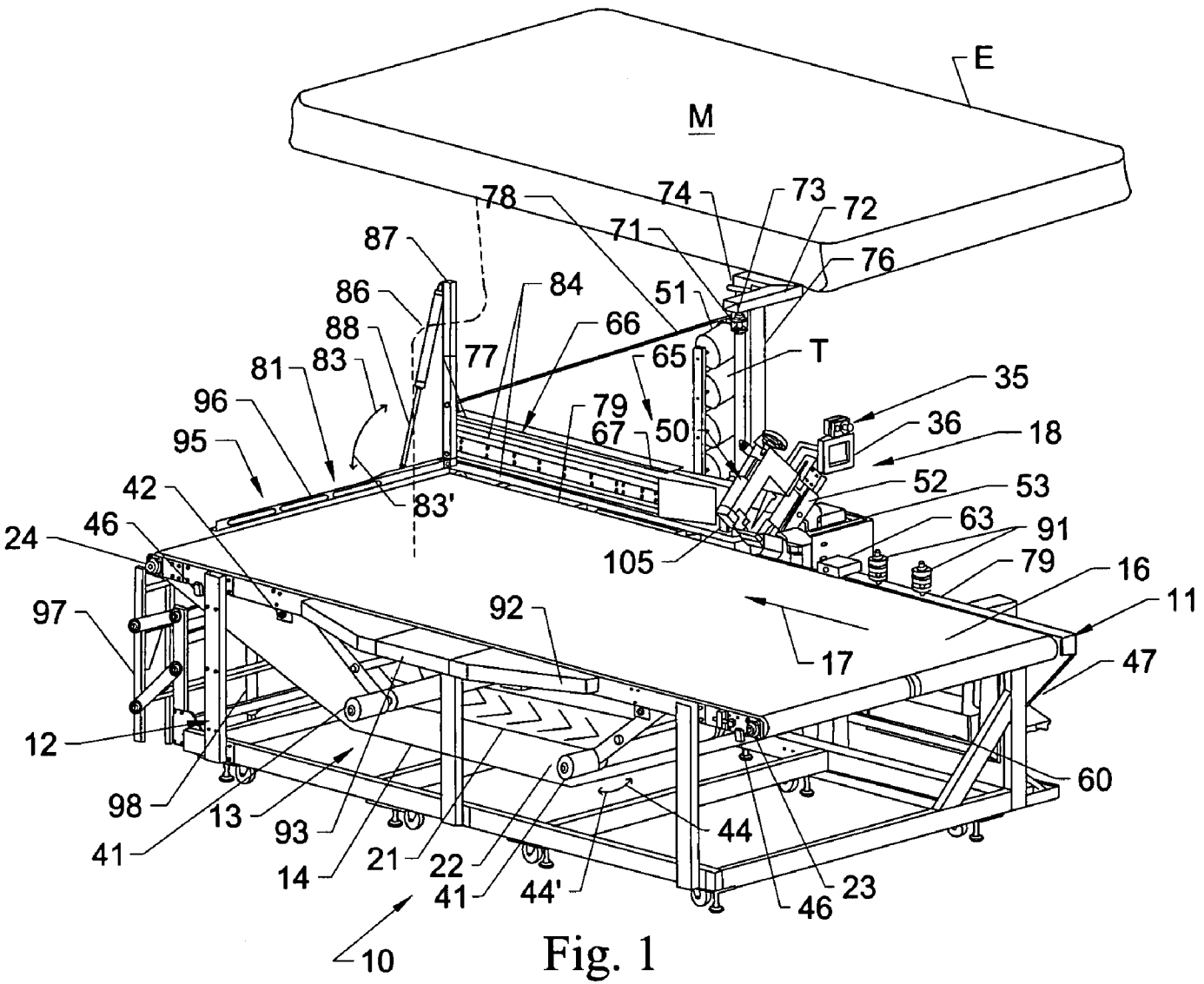
FIG. 1 is a perspective view of one example embodiment of the tape edge applicator workstation according to the principles of the present invention.
Figure 2:
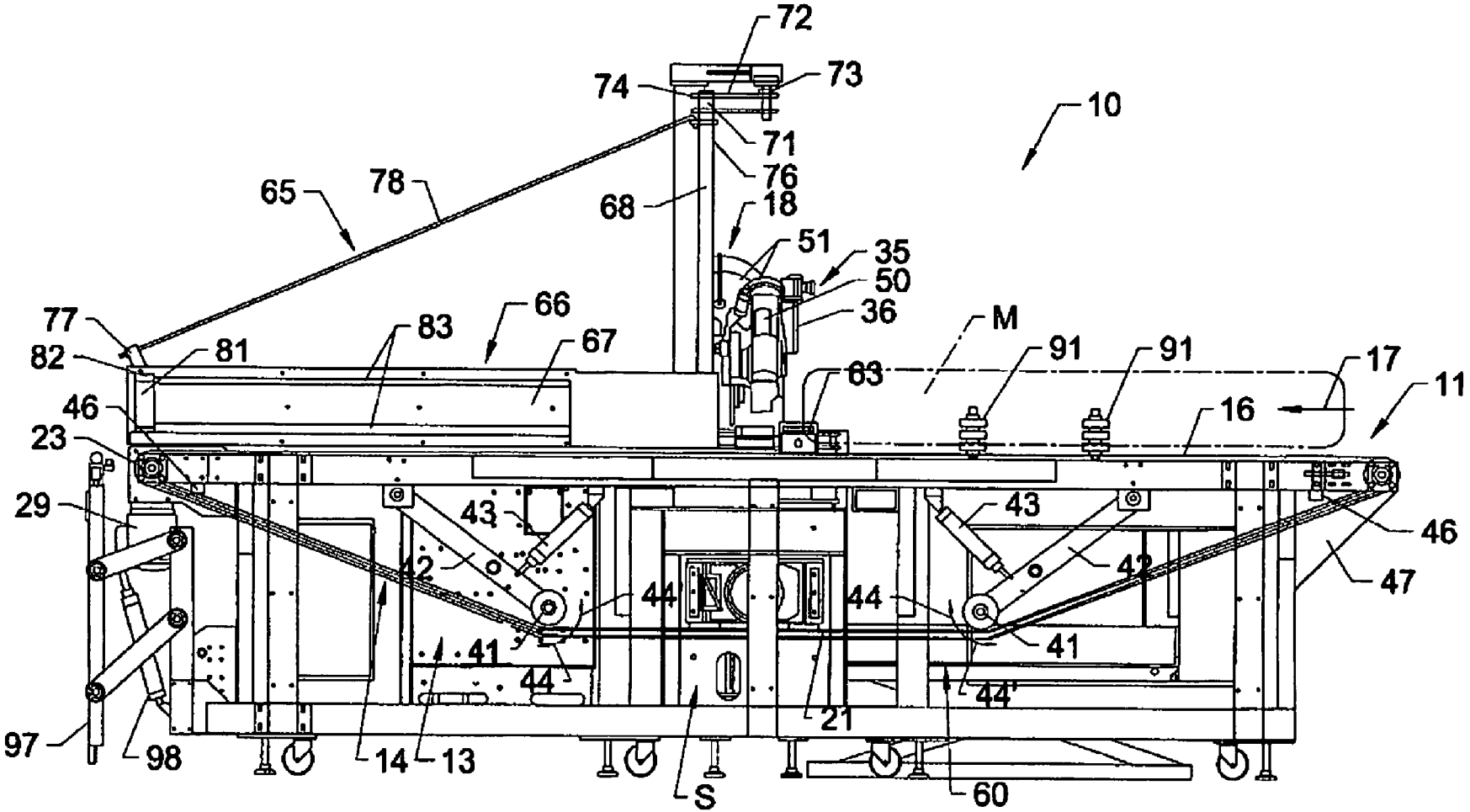
FIG. 2 is a side elevational view of the tape edge applicator workstation of FIG. 1.
Figure 3:
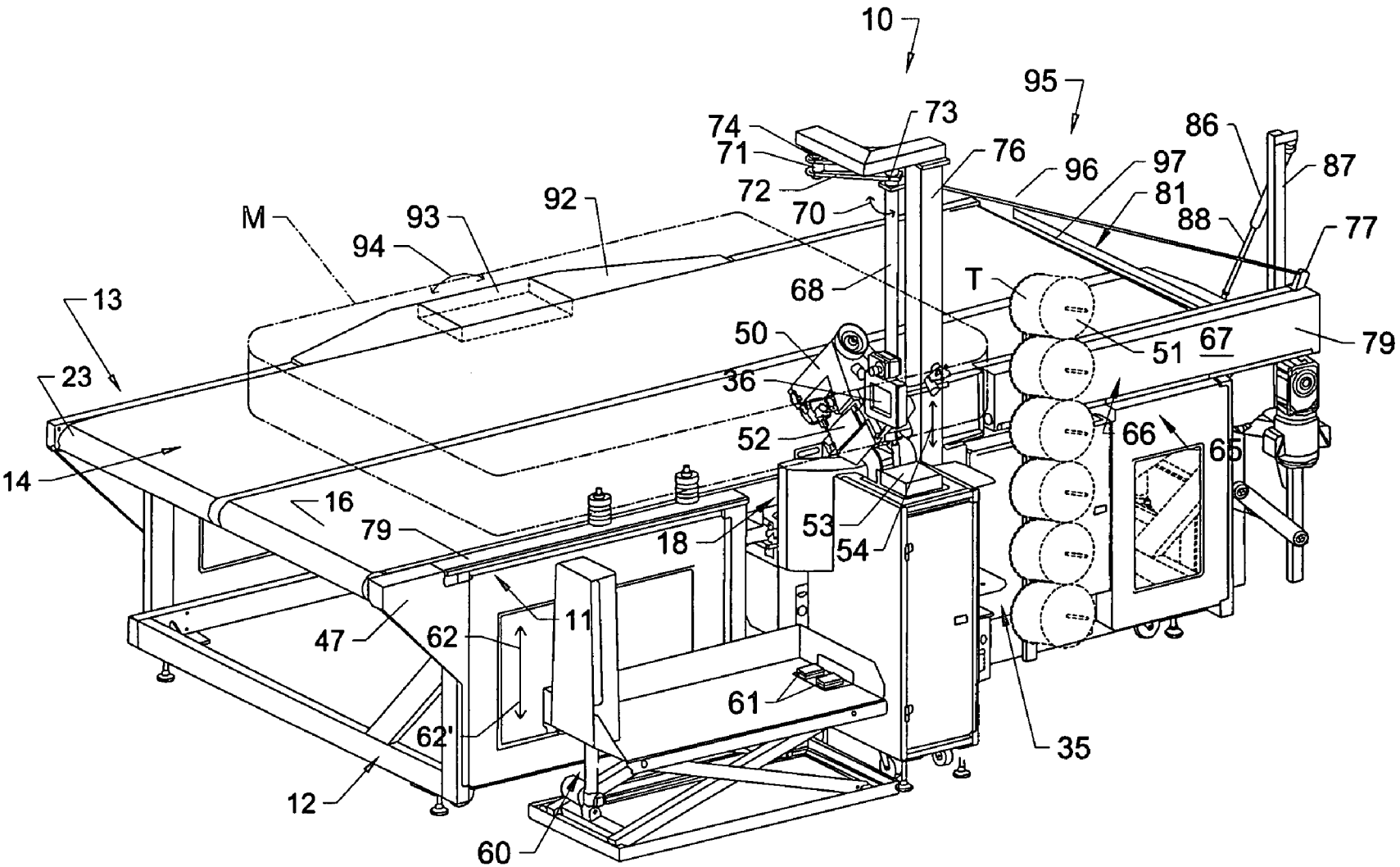
FIG. 3 is a perspective view of the tape edge applicator workstation, viewed from the operator side thereof.

Referring now to the drawings in which like numerals indicate like parts throughout the separate views, FIGS. 1-4C generally illustrate an automated system or workstation 10 according to the present invention, for applying a tape edge material T around the peripheral side edges E of a mattress M, foundation, or other bedding or furniture component. As indicated in FIGS. 1-3, the tape edge workstation 10 of the present invention generally will include an elongated worktable 11 having a support frame 12, with a conveyor 13 mounted thereon and including a conveyor belt 14 that extends over and is moveable along an upper surface 16 of the worktable 11 to transport the mattress M along a sewing path, indicated by arrows 17, through a tape edge applicator 18 for application of the tape edge material T along the sides E thereof.

As generally shown in FIGS. 1-3, the conveyor belt 14 generally is formed as an elongated, substantially flat belt having a smooth upper surface 19, which can have a tacky finish to prevent slippage or undue movement of the mattress M thereon. A "v-belt" or similar drive belt 21 (FIG. 1) can be attached along a center portion of the conveyor belt on the underside surface 22 of the conveyor belt 14. It will be understood that while only a single v-belt is disclosed as being used in the present embodiment, multiple v-belts or other drive belts also can be used as needed for driving and guiding the conveyor belt 14 about the frame of the workstation 10. The v-belt engages elongated drive shafts 23 and 24 of a conveyor drive system 13 that are positioned at the upstream and downstream edges 27 and 28 of the worktable. The conveyor drive system 13 also includes a drive motor 29 (FIG. 2) that drives at least one of the drive shafts (i.e., downstream shaft 24) so as to move or drive the conveyor belt 14 along its path of travel 17 to move the mattress M through the tape edge applicator. The conveyor drive motor further generally is a variable speed, reversible servo-motor or other similar type of motor, which is controlled by a system control 35 for the workstation 10 so as to drive the conveyor belt forwardly and rearwardly as needed to move the mattress M along its path of travel into and through the tape edge applicator workstation 10.

The system control 35 (FIGS. 2-3) of the tape edge applicator workstation 10 generally includes a programmable control processor (not shown) and an operator interface 36, such as a touch screen monitor, keypad or other input system or device through which the system control can be programmed to run various sizes and types of bedding components, including foundations or mattresses in twin, double, queen, king or various other sizes. The operator interface generally is mounted adjacent the tape edge applicator 18, as shown in FIG. 3 and also provides feedback and displays sewing/status indicator or warnings to the operator. The system control 35 further can comprise a serial bus control system such as embodied in U.S. Pat. No. 6,295,487, the disclosure of which is incorporated herein by reference. The system control generally monitors and controls the operation of various operative assemblies or components of the workstation 10, including the conveyor mechanism 13, tape edge applicator 18, a downstream turning mechanism 65 and a flipping mechanism 95 adjacent the downstream end of the worktable. Such operative assemblies can be constructed as individual or separate modules that can be linked or otherwise connected together in series and mounted together on the unitary workstation frame 12.

As additionally shown in FIG. 2, the conveyor belt 14 generally extends along the upper surface 16 of the worktable 11 between the upstream and downstream drive shafts 23/24, with the upper surface 16 of the conveyor belt on which the mattress is being supported during a tape edge application being substantially flat and taut in operation. The conveyor belt 14 is, however, of a length greater than the length of the worktable, generally having a length sufficient to provide a slack portion that hangs or extends downwardly from the upper portion thereof (as indicated by "S" in FIG. 2). The slack portion of the conveyor belt 14 typically is taken up and the conveyor belt tightened or made taut by engagement of the conveyor belt by one or more take-up or idler rolls 41 mounted on a pivoting arms 42 positioned below the upper surface 16 of the worktable 11. The arms 42 are pivotally attached to the frame 12 of the worktable and are moved between raised and lowered positions by actuators 43 such as pneumatic or hydraulic take-up cylinders. The actuators 43 move the take-up rolls upwardly out of contact with the conveyor belt and downwardly into pressing engagement with the conveyor belt 14, as shown by arrows 44 and 44' in FIG. 2.

The take-up cylinders 43 generally are controlled by the system control 35 for the tape edge applicator work station of the present invention so as to apply sufficient pressure to stretch the conveyor belt and to take-up or remove any slack from the conveyor belt, without placing undue stress or pressure on the conveyor belt that might cause de-lamination or separation of the ends of the conveyor belt. For example, sensors can be used to detect and provide feedback to the system control, such as an increase in resistance pressure in the actuators 43 as the conveyor belt is tightened, to allow the actuators to be locked to fix the take-up rolls 41 in place once the slack portion S has been taken up from the conveyor belt.

By providing the slack portion S in the conveyor belt 14, the conveyor belt can be quickly and easily changed-out and loaded on the frame and drive shafts 23 and 24 of the conveyor drive system 13. An operator can simply move the take-up rolls 41 to their raised, retracted positions, out of engagement with the conveyor belt to provide the slack and enable the conveyor belt to be removed from the drive shafts. Thereafter, a new conveyor belt can be slid onto the drive shafts, with its slack portion S hanging below the table surface and take-up rolls. The take-up rolls are then pivoted downwardly in the direction of arrows 44 and 44', into their engaging positions to automatically remove the slack from the conveyor belt.

In addition, air jets 46 (FIG. 2) can be provided along the frame 12 of the table 11 adjacent the upstream and downstream ends 27 and 28 of the table, or alternatively, adjacent the take-up rolls 41. The air jets can be periodically actuated by the system control to apply pressurized blasts of air against or along the underside surface 22 of the conveyor belt 14 to dislodge and prevent the undue buildup of lint and debris from collecting along the underside surface of the conveyor belt. Additionally, although not shown, the sides of the frame of the worktable can be enclosed with a grill or by perforated doors to conceal and protect the conveyor belt and take up rolls from unauthorized access, while enabling escape of the lint, dust, and other debris being dislodged from the conveyor belt by the air jets. The doors or grill further can be opened to enable an operator access as needed, such as to sweep out or otherwise clean off excess debris, dust, and lint from the underside of the conveyor belt.

Additionally, the worktable frame 12 and conveyor belt 14 (FIG. 2) of the present invention are designed such that the upper surface 16 of the worktable over which the upper portion of the conveyor belt is moved is supported via cantilevered supports 47 extending from the operator side of the worktable. As a result, the supports or legs of the worktable frame along one side of the conveyor mechanism 13 can be disengaged with the removal of a few bolts, so as to enable further quick access to the conveyor belt as needed.

As further illustrated in FIGS. 1-3, the tape edge applicator workstation 10 of the present invention includes a tape edge applicator 18, which typically includes a sewing head 50 and a support for a supply reel 51 of the tape edge material T mounted adjacent the operator side of the work table 11. The sewing head 50 of the tape edge applicator 18 can be mounted on a pivotable support bracket 52 that enables the sewing head 50 to pivot or tilt with respect to the side edges E of the mattress M being sewn. The support bracket 52 further is mounted on a vertically moveable support or platform 53 for raising and lowering the sewing head in the direction of arrows 54 and 54'. The sewing head 50 typically is a conventional sewing head having one or more sewing needles and a feed mechanism for feeding the tape edge material into a position overlying the matched side edges of the mattress for attaching the tape edge material thereto.

In addition, an operator platform 60 is provided adjacent the tape edge applicator 18 for supporting the operator. As shown in FIG. 3, foot pedals 61 can be provided on the operator platform for controlling a sewing operation of the tape edge applicator. Also shown adjacent the tape edge applicator and operator platform 60 is the operator interface 36 for the system control 35 to enable the operator to control or adjust the operation position and/or orientation of the sewing head of the tape edge applicator. For example, the operator can adjust the height and/or tilt of the tape edge applicator with respect to the side edges of the mattress being sewn on the worktable to ensure accurate and efficient sewing of the tape edge material along the side edges. The operator further can adjust the position of the operator platform with respect to both the height of the mattress being sewn and the tape edge applicator itself, moving it in the direction of arrows 62 and 62' via the system control 35. Such adjustments can be synchronized such that once the operator has determined the proper height of the operator platform and positioned the tape edge applicator 18 at a desired working height for that particular operator, such height positions or other parameters can be set/programmed into the system control. Thereafter, any adjustments to the height or position of the tape edge applicator automatically will result in corresponding adjustments to the operator platform.

Figure 4A:
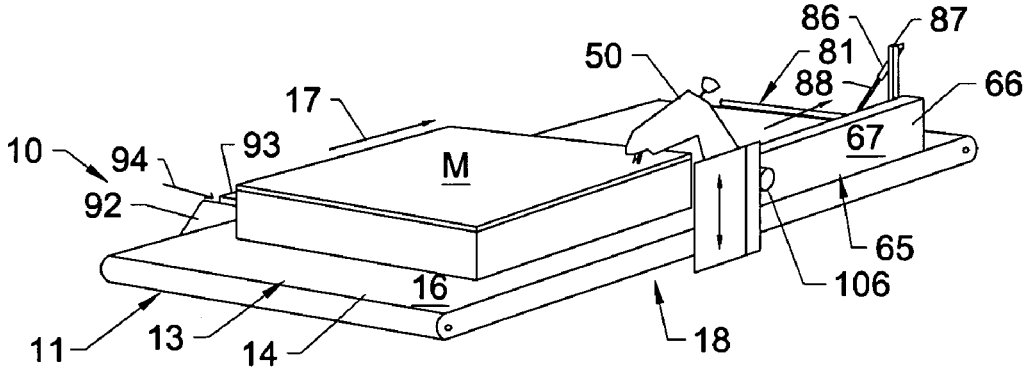
FIGS. 4A-4C are perspective views schematically illustrating the application of the tape edge material, rotation of the bedding component, and flipping of the bedding component for application of the tape edge material about the side edges thereof.
Figure 4B:
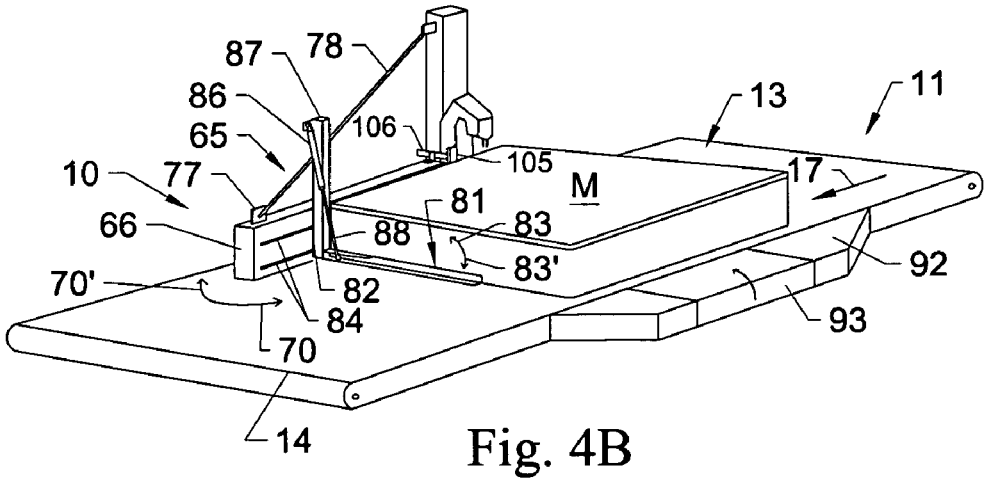

As additionally indicated in FIGS. 1 and 2, a sensor 63 is mounted adjacent the conveyor belt and the sewing path 17 of the mattress, upstream from the tape edge applicator 18. The sensor 63 can be a photocell, proximity sensor or other type of detector that monitors the movement of the mattress M past the tape edge applicator and sends a signal to the system control 35 as a trailing corner of the mattress passes thereby to signal the approach of the trailing corner to the tape edge applicator. Upon receiving this signal, the system control thereafter can determine, such as based upon a count of the number of stitches going forward, when the trailing corner of the mattress will reach the sewing head of the tape edge applicator 18, and can accordingly activate a turning mechanism 65 for rotating the mattress to present a next side edge of the mattress for application of the tape edge material thereto, as indicated in FIGS. 4A-4B.

The turning mechanism 65 is illustrated in FIGS. 1-3 and 4B and includes a turning arm 66 positioned along the operator side of the tape edge applicator workstation 10 of the present invention. The turning arm 66 generally includes an elongated body 67 that extends substantially along the worktable 11 from a position adjacent the tape edge applicator 18 toward the downstream or distal end 28 of the worktable. The turning arm is mounted on a vertically extending pivot mechanism or support bar 68, the lower end of which is connected to the drive shaft of a drive motor 69 (FIG. 2), controlled by the system control 35 for the tape edge applicator workstation. The drive motor causes the turning arm 66 to be pivoted or rotated across the width of the worktable 11 in the direction of arrows 70 and 70' (FIG. 4B) for rotating the mattress to the next side edge to which a tape edge is to be applied. As shown in FIGS. 2-3, the upper end 71 of the pivot mechanism 68 is attached to a pivoting support arm 72, adjacent a first end 73 thereof, with the opposite end 74 of the support arm 72 being pivotally attached to a stanchion or brace 76 above the surface of the worktable 11.

As also shown in FIGS. 1-3, the distal end 77 of the turning arm 66 generally will be supported by a cantilevered support rod or cable 78 that is attached at the first end 72 of the pivoting support arm 73, adjacent the vertically extending support brace of the turning arm. This support rod 78 supports the distal end 77 of the turning arm 66 above the conveyor belt 14 during rotation of the turning arm to prevent sagging or dragging of the turning arm against the upper surface of the conveyor, which could catch, scratch, or otherwise damage the upper surface of the conveyor belt. In addition, the edges of the conveyor belt further can be sealed within guide plates 79 (FIG. 1) that extend along the side edges of the conveyor belt to help protect the side edges of the conveyor belt and prevent catching or other damage thereto, such as during rotation of the turning arm.

As indicated in FIG. 1, the turning arm 66 further includes a pivoting guide arm or plate 81 that is attached to the distal or free end 77 of the turning arm. The guide arm 81 can be pivotally mounted on a carriage or bracket 82 so as to be pivotable as indicated by arrows 83/83' from a raised, rest, or non-engaging position to a lowered, engaging position extending outwardly from the turning arm and across the workstable and conveyor during the sewing applications so that the forwardly facing side or end of the mattress is engaged thereagainst, as shown in FIGS. 1 and 4B. The guide arm 81 also is moved longitudinally along the length of the turning arm 66, with its carriage 82 riding along guide tracks 84 extending along the body of the turning arm during a tape edge application to a desired stopping point once the sewing of the tape edge along the current side edge of the mattress is completed.

In the present embodiment, as illustrated, in its lowered, engaging position, the pivoting guide arm 81 extends between six to twelve inches outwardly from the turning arm, such that the corner of the mattress is received and resting between the guide arm and turning arm. It will, however, be understood by those skilled in the art that the pivoting guide arm further can be formed with a greater or lesser length as desired, including being formed of a length that extends substantially across the width of the worktable. Still further, the pivoting guide arm can be formed as a telescoping member that can be extensible across the width of the worktable. A cylinder 86 (FIG. 1) or other, similar actuator typically will be mounted on an upstanding support 87 adjacent the bracket 82 and will include an extensible cylinder rod 88 attached at its distal or free end to the guide plate. The cylinder is controlled by the system control and moves the guide plate between its engaging and non-engaging positions at the end of a sewing operation.

In addition, as shown in the attached drawings, guide rollers 91 are positioned along the operator side of the worktable 11 upstream from the tape edge applicator 18. These guide rollers 91 can be adjusted laterally toward and away from the worktable, and typically will be slightly offset from the worktable. As a result, when the mattress M is urged thereagainst, the side edge E of the mattress to be sewn will be presented at a slight angle or offset with respect to the tape edge applicator 18 to ensure proper feeding the mattress therein for application of the tape edge along its side edge.

As additionally indicated in FIGS. 1, 3, and 4A-4B, a support platform 92 is positioned along the opposite side of the worktable 11 from the tape edge applicator 18. The support platform 92 projects outwardly from the worktable 11 to provide an additional support surface for the mattress during a turning operation. An adjustment pad 93 is mounted within the support platform 92 and is moveable upwardly and inwardly toward the mattress as indicated by arrows 94 (FIGS. 3 and 4B). As the pad 93 is moved to its raised engaging position, it tends to engage and urge the mattress across the upper surface of the conveyor belt 14 and against the guide rollers 91 (FIG. 3) to help position and align the side edges of the mattress for attachment of the tape edge material thereto.

Figure 4C:
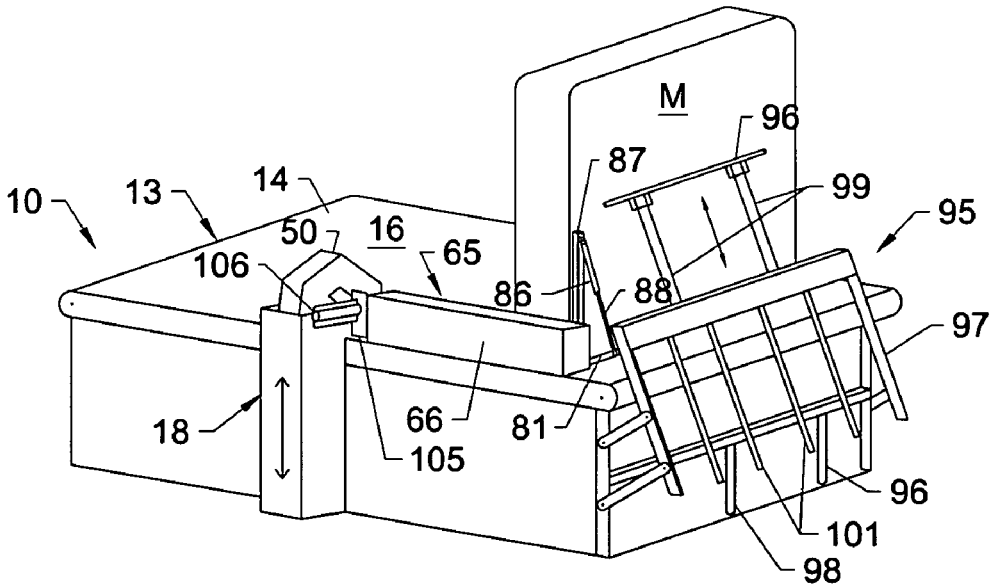

As further shown in FIGS. 1, 2 and 4C, a mattress flipping mechanism 95 is provided at the downstream end 28 of the worktable 11, although it can be positioned at either end of the worktable as needed. The mattress flipping mechanism 95 generally includes an extensible flipper bar 96 that extends substantially across the width of the worktable, and is moved into engaging position by engagement with the lower surface of a mattress M moved thereover by a pivoting support frame 97. The pivoting support frame of the mattress flipping mechanism generally is attached to the frame 12 of the worktable 11 and is movable from a lowered, non-engaging position, shown in FIG. 2, to a raised, engaging position, shown in FIG. 4C, by a drive mechanism 98 such as one or more pneumatic cylinders, drive motors, or other, similar drive. The flipper bar 96 generally is attached to a pair of extensible control or guide rods 99 that telescope into and out of the pivoting support frame 97. The control rods 99 for the flipper bar 96 generally are attached to cylinders 101 (or can be the cylinder rods of such cylinders) that are mounted to and thus moved with the pivoting support frame, and are actuated by the system control to automatically extend and retract the flipper bar during a turning or flipping operation as indicated in FIG. 4C.

After all four peripheral side edges of an upper or lower surface of the mattress M have had the tape edge material applied thereto, the mattress will be conveyed by the conveyor 13 to the downstream edge of the worktable, to a flipping position. The flipper bar 96 then will be engaged and moved upwardly, causing the downstream end of the mattress to likewise be raised, as shown in FIG. 4C, as the conveyor continues to move the trailing end of the mattress forwardly. The flipper bar generally is extended upwardly and inwardly toward the upstream edge of the worktable so that the mattress is progressively urged upwardly and caused to flip over onto its previously sewn surface or edges. Thereafter, the mattress can be moved rearwardly by reversal of the conveyor belt, so as to reposition the mattress upstream of the tape edge applicator.

In addition, the side of the mattress can be engaged by a push plate 105, as indicated in FIGS. 1, 2, an 4C, to urge the mattress across the conveyor and away from the sewing head as needed to position the mattress for flipping. An actuator such as a cylinder 106 is attached to the push plate 105 for moving the push plate laterally across the conveyor as needed to move the mattress toward the center of the conveyor belt and into its flipping position. Thereafter, once the tape edge application has been completed on all the desired mattress or foundation side edges, the mattress can be conveyed off the worktable by the continued forward movement of the conveyor belt for transfer to a downstream packaging operation.

In operation of the present invention, the mattress, foundation, or other bedding component generally indicated as M in FIGS. 1-4A, is placed on the upper surface 19 of the conveyor belt 14. The mattress M typically is aligned against the guide rollers 91 and initially is positioned extending partially past the sewing head 50 of a tape edge applicator 18 mounted along one side of the conveyor 14, at the start of the tape edge application operation. Typically, the application of the tape edge material will begin at an intermediate point, such as the midpoint, along a first side edge of an upwardly facing surface of the mattress or bedding component M. Prior to starting, the operator can adjust the position of the sewing head of the tape edge applicator vertically in the direction of arrows 54 and 54', while at the same time, typically adjusting the position of the operator platform 60 with respect to the conveyor and mattress according to the operator's preferences.

Once the tape edge application operation commences, the conveyor 13 (FIGS. 1 and 3) moves the mattress or other bedding component M in the direction of arrows 17 toward the downstream end of the worktable as the tape edge material is fed into an overlying relationship about the side edge of the mattress and is attached thereto by the sewing head 50. As a trailing corner of the mattress approaches the sewing head, a sensor 63 detects and signals the system control of the approach of the trailing corner toward the sewing needle of the sewing head. In response, as the corner nears the sewing needle, the system control 35 actuates turning mechanism 65, which rotates its turning arm 66 about pivoting support 68, moving in the direction of arrows 70 across the width of the conveyor belt, as illustrated in FIG. 4B. As a result, the mattress M, with its leading corner is engaged between the guide arm 81 and body 67 of the turning arm 66 is caused to pivot or rotate about the sewing needle as the sewing needle continues to sew the tape edge material about the corner. The speed of the tape edge applicator operation can be slowed or run at a more controlled rate during the turning operation as needed to ensure consistency as the tape edge material is sewn about the corner of the mattress. As the rotation or turning of the mattress is completed, a next side edge to be sewn is presented and aligned along the sewing path 17 in alignment with the sewing head. Thereafter, the conveyor belt 14 is reengaged so as to move the mattress forwardly in the direction of arrow 17 through the tape edge applicator 18. The turning process is repeated as the tape edge material is applied about all four side edges and corners of the upwardly facing surface of the mattress.

After the tape edge material has been applied around all the peripheral edges of the upwardly facing surface of the mattress, the tape edge applicator 18 can be disengaged or deactivated temporarily, while the push plate 105 moves or urges the mattress toward the center of the conveyor belt. Thereafter, the guide arm 81 of the turning arm will be automatically folded or pivoted in the direction of arrow 83' out of the path of the mattress so as to not interfere with the further forward movement of the mattress by the conveyor belt. The conveyor belt then is reengaged and transports the mattress toward the downstream end of the worktable in the direction of arrow 17 for commencement of the turning or flipping operation.

At the downstream end of the worktable, the leading end or side of the mattress is engaged by a flipper bar 96 of turning mechanism 95. As the conveyor 13 continues to move the trailing end of the mattress forwardly in the direction of arrow 17, the flipper bar is raised by its cylinders 101 so as to cause the leading end of the mattress to be raised upwardly and urged rearwardly. As a result, the mattress is caused to flip or turn over onto its previously sewn surface, as indicated in FIG. 4C. Thereafter, the operation of the conveyor belt 14 will be reversed so as to move the mattress rearwardly to a position downstream from the tape edge applicator 18. At about the same time, an adjustment pad 93 can be moved into engagement with a side of the mattress, to urge the mattress laterally across the width of the conveyor belt toward the tape edge applicator to help reposition the mattress for application of the tape edge material about the edges of the mattress.

It further will be understood by those skilled in the art that various changes, modifications, and additions can be made to the forgoing invention without departing from the spirit and scope of thereof.

We claim:

1. A tape edge applicator workstation for applying a tape edge material about peripheral edges of a mattress, comprising:

a support table having an elongated conveyor mechanism for moving the mattress along a sewing path;

a tape edge applicator for applying a tape edge material about the edges of the mattress; and a turning mechanism for engaging and turning the mattress with respect to a sewing needle of the tape edge applicator to enable continued sewing along a next adjacent edge of the mattress;

wherein the conveyor mechanism comprises an elongated conveyor belt extended about upstream and downstream rolls and having an increased length to provide a slack portion therein, and at least one take-up roll moveable into engagement with the slack portion of the conveyor belt to substantially reduce the slack portion and maintain a tension in the conveyor during operation and out of engagement with the conveyor to release the slack portion for ease of replacement of the conveyor belt.

2. The tape edge applicator workstation of claim 1 and wherein the at least one take-up roll comprises a pair of idler rolls mounted on moveable support arms for moving the rolls between engaging and non-engaging positions.

3. The tape edge applicator workstation of claim 2 and further comprising actuators connected to the moveable support arms for controlling movement of the support arms and idler rolls between their engaging and non-engaging positions.

4. The tape edge applicator workstation of claim 1 and further comprising at least one air jet for supplying a flow of air across a surface of the conveyor.

5. The tape edge applicator workstation of claim 1 and wherein the turning mechanism comprises a moveable turning arm pivotally supported above and moveable across an upper surface of the conveyor belt between a rest position and a turning position without engaging the upper surface of the conveyor belt.

6. The tape edge applicator workstation of claim 5 and further comprising a guide plate moveably mounted on the turning arm so as to be moveable longitudinally therealong with a corner portion of the mattress engaged between the guide plate and turning arm to help control the turning of the mattress by the turning arm.

7. The tape edge applicator workstation of claim 6 and further comprising a carriage moveably mounted along the turning arm, and wherein said guide plate is pivotably mounted to the carriage so as to be pivotable with respect to the turning arm between an extended, engaging position engaging a portion of the mattress and a retracted position out of contact with the mattress.

8. The tape edge applicator workstation of claim 1 and further comprising an adjustment mechanism positioned along an outer side edge of the conveyor and adapted to move into engagement with and urge the mattress laterally across the conveyor into a position for engagement by the tape edge applicator.

9. A method of applying a tape edge material along matched side edges of bedding comprising:

a. placing a conveyor belt on a series of drive rolls;

b. engaging the conveyor belt with a take-up roller to take up slack in the conveyor belt;

c. driving the conveyor belt so as to move the bedding along a sewing path adjacent a tape edge applicator;

d. attaching the tape edge material along a side edge of the bedding as the bedding is moved adjacent the tape edge applicator;

e. as a corner of the bedding approaches the tape edge applicator, turning the bedding to present a next side edge of the bedding for attachment of the tape edge material thereto; and f. repeating steps d-e until the tape edge material has been applied to each of the side edges along an upwardly facing surface of the bedding.

10. The method of claim 9 and further comprising inverting the bedding.

11. The method of claim 10 and wherein inverting the bedding comprises moving the bedding to a downstream position with the conveyor, engaging the bedding with a flipping mechanism, and flipping the bedding over.

12. The method of claim 9 and wherein turning the bedding comprises engaging the bedding with a turning arm and rotating the bedding as the tape edge material is applied about the corner of the bedding.

13. The method of claim 12 and wherein engaging the bedding with the turning arm comprises moving the bedding into contact with a guide plate projecting from the turning arm so that a corner portion of the bedding is received between the guide arm and turning arm.

14. The method of claim 12 and further comprising supporting the turning arm above the conveyor belt as the turning arm rotates the bedding.

* * * * *